US007325262B2

(12) United States Patent
Keith

(10) Patent No.: US 7,325,262 B2
(45) Date of Patent: Feb. 5, 2008

(54) BEDDING HEM WITH ASSOCIATED INTERLINING

(75) Inventor: Timothy F Keith, Loveland, OH (US)

(73) Assignee: Standard Textile Co., Inc., Cincinnati, OH (US)

( * ) Notice: Subject to any disclaimer, the term of this patent is extended or adjusted under 35 U.S.C. 154(b) by 0 days.

(21) Appl. No.: 10/906,695

(22) Filed: Mar. 2, 2005

(65) Prior Publication Data

US 2005/0235420 A1 Oct. 27, 2005

(51) Int. Cl.
*A47G 9/02* (2006.01)
*B32B 7/08* (2006.01)

(52) U.S. Cl. ..... 5/482; 5/502; 112/423

(58) Field of Classification Search ..... 5/482, 5/502, 495; 112/423–426, 441
See application file for complete search history.

(56) References Cited

U.S. PATENT DOCUMENTS 2,020,971 A * 11/1935 Silverstein ..... 112/423
2,323,507 A 7/1943 Wood
2,713,685 A * 7/1955 Nachem ..... 112/424
3,038,167 A * 6/1962 Rajki ..... 112/415
3,168,749 A * 2/1965 Cala ..... 2/269
3,316,566 A 5/1967 Long
3,478,366 A * 11/1969 Kaufman ..... 2/74
3,829,914 A * 8/1974 Treat ..... 5/81.1 T (Continued)

OTHER PUBLICATIONS http://www.springs.com/ourproducts/bed_linens/court_of_versailles/pillows_and_complements/euro_shams.asp.

(Continued)

*Primary Examiner*—Michael Trettel
(74) *Attorney, Agent, or Firm*—Wood, Herron & Evans, LLP

(57) ABSTRACT

A bedding product in the form of a flat bed sheet (36) includes a top end (38), a bottom end (40), a left side end (42), and a right side end (44), with each end including a hem (46, 48, 50, 52) having an associated interlining. For example, the bottom end hem (48) defines an elongated interior space (60). And the interlining, in the form of an elongated strip (54), is contained in the interior space (60). The hem (48), itself, has an inner edge (62) at the upper surface (56) of the sheet (36), and an outer edge (64) spaced from the inner edge (62), with the outer edge (64) also being the bottom edge of the sheet (36). In addition, the hem (48) has a free end (66) that is wrapped around a portion of the interlining strip (54), near the hem inner edge (62), and is tucked into the interior space (60). The interlining strip (54) is held in position within the interior space (60) of the hem (48) by two rows of stitches. The first row of stitches (68) is near the inner edge (62), with the stitches (68) passing through the hem (48) (including a portion of the free end 66) and the interlining strip (54). The second row of stitches (70) is near the outer edge (64), with the stitches (70) passing through the hem (48) and the interlining strip (54). The interlining strip (54) extends generally the length of the hem (48). The sheet (36) has a greater resistance to creasing and wrinkling than a conventional bed sheet, without an increase in overall bed sheet costs (e.g., purchase, laundering, and other handling costs), and without sacrificing the comfortable feel of the sheet.

14 Claims, 2 Drawing Sheets

U.S. PATENT DOCUMENTS

| | | | | |
|---|---|---|---|---|
| 4,012,550 | A | 3/1977 | Hollander | |
| 4,102,550 | A | 7/1978 | Campbell et al. | |
| 4,352,217 | A | 10/1982 | O'Rourke | |
| 4,430,765 | A | 2/1984 | Karpen | |
| 4,464,160 | A | 8/1984 | Joyce | |
| 4,486,902 | A | 12/1984 | Sakai | |
| 4,491,079 | A | 1/1985 | Gustavsson | |
| 4,658,454 | A | 4/1987 | Potter | |
| 4,776,047 | A | 10/1988 | DiMatteo | |
| 4,799,272 | A | 1/1989 | Horng | |
| 4,799,273 | A | 1/1989 | Elze | |
| 4,860,388 | A | 8/1989 | Dean | |
| 5,008,966 | A | 4/1991 | Lepow | |
| 5,280,657 | A | 1/1994 | Stagg | |
| 5,427,834 | A * | 6/1995 | Sodetz | 428/83 |
| 5,782,191 | A | 7/1998 | Wong | |
| 5,941,186 | A * | 8/1999 | Argentino | 112/441 |
| 6,038,785 | A | 3/2000 | Lawson et al. | |
| 6,114,262 | A | 9/2000 | Groh et al. | |
| 6,560,797 | B2 * | 5/2003 | Maturaporn | 5/482 |
| 6,615,837 | B1 | 9/2003 | Griesbach, III | |
| 6,668,400 | B1 | 12/2003 | Nichols et al. | |
| 6,842,921 | B1 | 1/2005 | Tsiarkezos et al. | |
| 7,043,786 | B1 | 5/2006 | Hall et al. | |
| 2002/0081387 | A1 | 6/2002 | Kaiser et al. | |
| 2002/0116763 | A1 | 8/2002 | Weir et al. | |

OTHER PUBLICATIONS

International Search Report for application No. PCT/US2006/003438, mailed May 23, 2006.

Written Opinion for application No. PCT/US2006/003438, mailed May 23, 2006.

Jun. 2, 2006 letter from Steve Rosenblatt to Walter Spiegel (2 pg).

May 2, 2006 letter from Larry Pearson, Quiltcraft, to Vijay Bhuta attached to the Jun. 2, 2006 letter from Steve Rosenblatt to Walter Spiegel (1 pg).

Portion of pillowcase attached to the Jun. 2, 2006 letter from Steve Rosenblatt to Walter Spiegel.

Oct. 20, 2006 letter from Steven Rosenblatt including three declarations submitted therewith, (6 pg.).

Letter dated Jan. 10, 2007 from Steve Rosenblatt (6pages).

www.kojoworldwide.com (Website Link to Kojo Worldwide provided by Mr. Rosenblatt).

Feb. 26, 2007 letter from Steve Rosenblatt to Kurt Grossman including Declaration of Koni Kom, President of Kojo Worldwide, dated Feb. 22, 2007, (5 pages).

Five color photographs (labeled "Bed Throw") of a bed throw sample that accompanied the Feb. 26, 2007 letter from Steve Rosenblatt to Kurt Grossman, (5 pages). The bed throw sample was hand delivered to Examiner on Mar. 13, 2007 and he removed and retained a portion thereof for the file.

Mar. 1, 2007 letter from Steve Rosenblatt to Kurt Grossman including Declaration of Koni Kim, President of Kojo Worldwide, dated Feb. 20, 2007, (3 pages).

Four color photographs (labeled "Bed Blanket") of a bed blanket sample that accompanied the Mar. 1, 2007 letter from Steve Rosenblatt to Kurt Grossman, (4 pages). The bed blanket sample was hand delivered to Examiner on Mar. 13, 2007 and he removed and retained a portion thereof for the file.

Mar. 12, 2007 letter from Steve Rosenblatt to Kurt Grossman including Declaration of Todd Kassap, Vice President of SK Textile, dated Mar. 9, 2007, (3 pages).

Four color photographs (labeled "SK1") of a pillow cover sample (SK1) that accompanied the Mar. 12, 2007 letter from Steve Rosenblatt to Kurt Grossman, (4 pages). The pillow cover sample (SK1) was hand delivered to Examiner on Sep. 21, 2007 and he removed and retained a portion thereof for the file.

Five color photographs (labeled "SK2") of a bed cover sample (SK2) that accompanied the Mar. 12, 2007 letter from Steve Rosenblatt to Kurt Grossman, (5 pages). The bed cover sample (SK2) was hand delivered to Examiner on Sep. 21, 2007 and he removed and retained a portion thereof for the file.

Feb. 15, 2007 letter from Steve Rosenblatt (13 pages).

Jan. 17, 2007 letter from Kurt Grossman (3 pages).

* cited by examiner

BEDDING HEM WITH ASSOCIATED INTERLINING

FIELD OF THE INVENTION

This invention relates to bedding, and more particularly, to bedding products that include hems.

DESCRIPTION OF RELATED ART

When bedding (for example, sheets, pillow cases, and the like) is washed, either in a residential, commercial, or industrial laundry environment, the washing process typically causes the bedding to become creased and wrinkled. For example, in a wash cycle, as the bedding becomes soaked with wash water, the bedding becomes quite heavy. Then, as the wash water drains, the bedding collapses on itself, and numerous creases begin to form. These creases then become further defined during a spin cycle. Over the course of the drying process, some of the creases and wrinkles may disappear, and many may become less noticeable. Others, however—particularly those in the hems finishing the edges of the bedding—tend to remain.

Oftentimes, the only way to remove the post-laundering creases and wrinkles is to iron the bedding—a process that, at the least, is time consuming. And in a commercial or industrial setting, the addition of an ironing step may be extremely costly, involving not only labor costs but also large-scale-equipment purchase-and maintenance-costs. These same drawbacks can occur with other bedding, for example, pillow shams, dust ruffles, blankets, bedspreads, and duvet covers.

SUMMARY OF THE INVENTION

The present invention provides bedding, for example, sheets, pillow cases, pillow shams, dust ruffles, blankets, bedspreads, and duvet covers, in which the hems have a greater resistance to creasing and wrinkling than those of conventional bedding, without sacrificing the comfortable feel of the bedding. To this end, and in accordance with the principles of the invention, the resistance enhancement is accomplished by associating an interlining with one or more of the hems of the bedding. The interlining may be, for example, an elongated strip that is cut from a piece of fabric or a sheet of foam, and may provide a desired degree of resilience or stiffness to reduce the incidence of creasing and wrinkling of the hems. The interlining may be associated with the hem by being retained in the interior space defined by the hem. If desired, the interlining may be attached to the fabric that forms the hem. For example, the interlining may be stitched and/or fused to the fabric. Also, all the hems of a bed sheet, for example, may have an associated interlining. Furthermore, if desired, the interlining may extend the full length of the hem(s).

By virtue of the foregoing, there is thus provided bedding, for example, sheets, pillow cases, pillow shams, dust ruffles, blankets, bedspreads, and duvet covers, in which the hems have a greater resistance to creasing and wrinkling than those of conventional bedding, without sacrificing the comfortable feel of the bedding. These and other advantages of the present invention will be apparent from the accompanying drawings and description of the drawings.

BRIEF DESCRIPTION OF THE DRAWINGS

The accompanying drawings, which are incorporated in, and constitute a part of this specification, illustrate embodiments of the invention, and, together with the general description of the invention given above, and the detailed description of embodiments of the invention given below, serve to explain the principles of the invention. The drawings are schematic, and are not to scale.

DETAILED DESCRIPTION OF THE DRAWINGS

Figure 1:
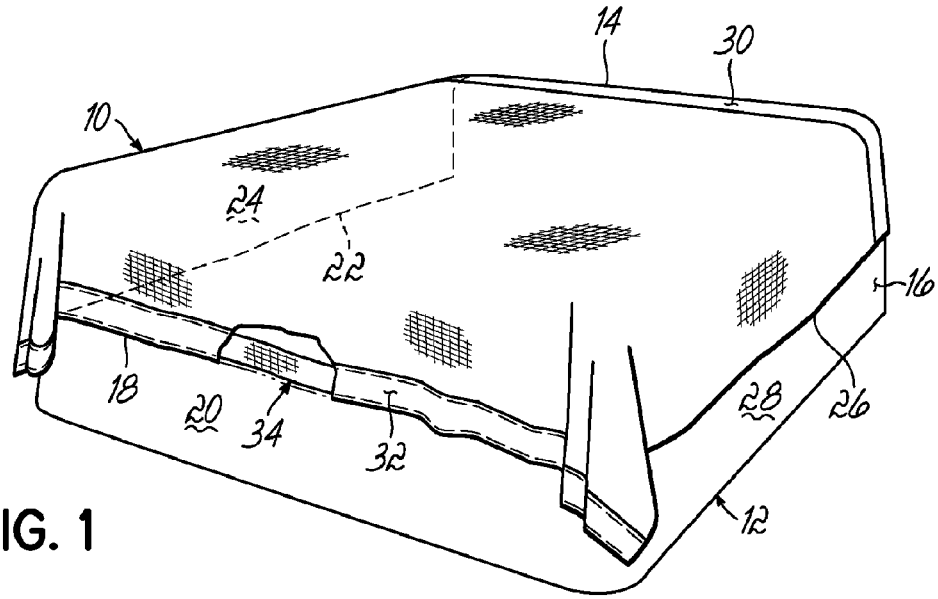
FIG. 1 is a perspective, partially cut-away view of a bedding product in the form of a flat bed sheet, partially cut-away, in accordance with the principles of the invention, positioned on a bed.

With reference to FIG. 1, a bedding product in the form of a flat bed sheet 10 is spread out on the top of a bed 12. The sheet 10 includes a top end 14 positioned at the head 16 of the bed 12, a bottom end 18 draped over the foot 20 of the bed 12, a left side end 22 draped over the left side 24 of the bed 12, and a right side end 26 draped over the right side 28 of the bed 12. In further detail, each of the top and bottom ends 14, 18 is finished with a hem 30, 32 each having an interlining in the form of an elongated interlining strip 34 (only one shown) associated therewith.

Figure 2:
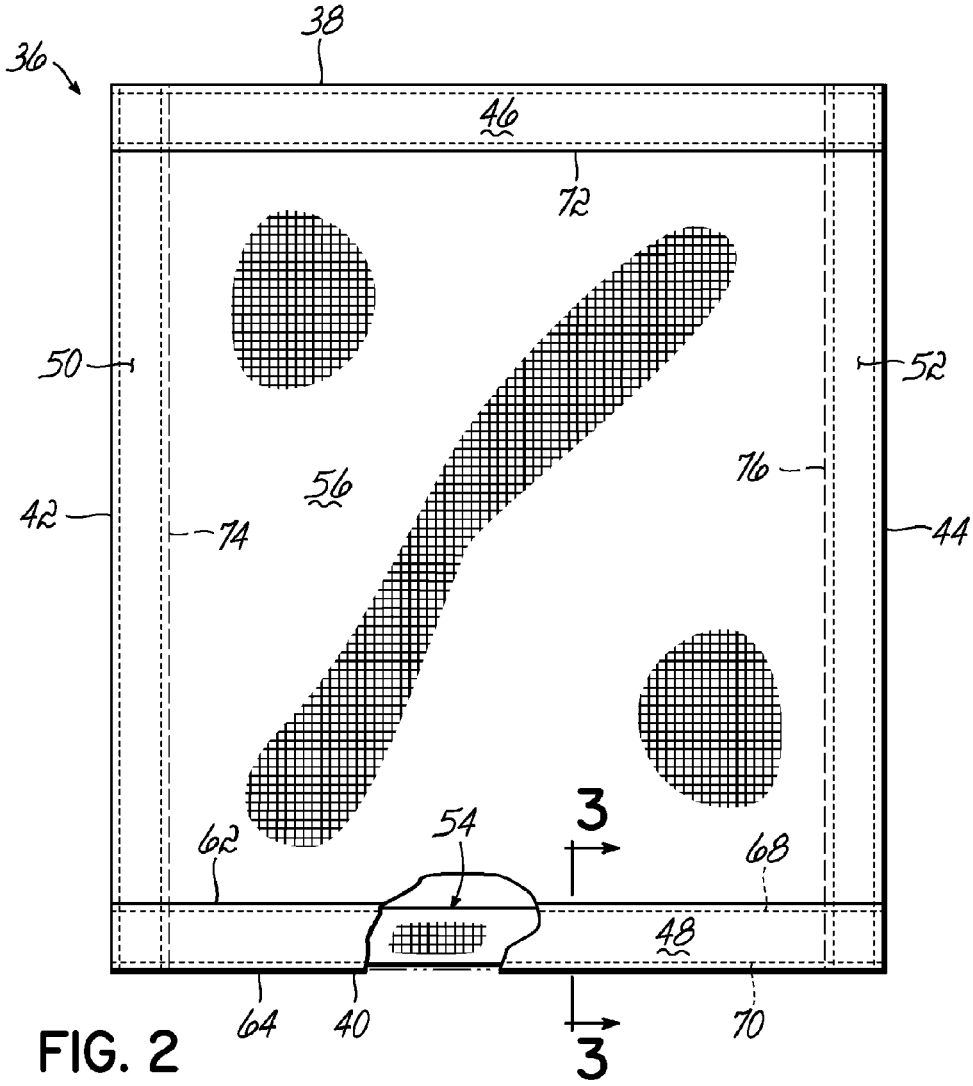
FIG. 2 is an elevational, partially cut-away top view of a flat bed sheet in accordance with the principles of the invention.
Figure 3:
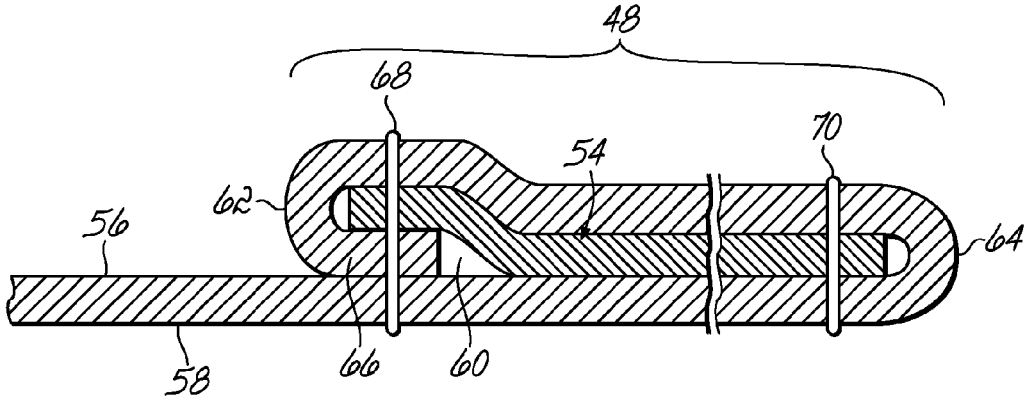
FIG. 3 is a cross-sectional view of a portion of the bottom end of the sheet of FIG. 2, taken along line 3—3, showing one way of associating an interlining with a hem.

With reference to FIGS. 2 and 3, a bedding product in the form of a flat bed sheet 36 includes a top end 38, a bottom end 40, a left side end 42, and a right side end 44. Each of the ends 38, 40, 42, 44 is finished with a respective hem 46, 48, 50, 52 each having an interlining in the form of an elongated interlining strip 54 (only one shown) associated therewith. Each elongated strip (as at 54) may be associated with its corresponding hem 46, 48, 50, 52 in any of a number of different ways. The bed sheet 36 also has an upper surface 56 and an oppositely disposed lower surface 58 (FIG. 3).

With reference to FIG. 3, each hem (only representative bottom hem 48 being shown) defines an elongated interior space 60. The elongated interlining strip 54 is contained in the interior space 60. The bottom hem 48, itself, has an inner edge 62 at the upper surface 56 of the bed sheet 36, and an outer edge 64 spaced from the inner edge 62, with the outer edge 64 also being the bottom edge of the entire bed sheet 36. In addition, the hem 48 has a free end 66 that is wrapped around a portion of the interlining strip 54, near the hem inner edge 62, and is tucked into the interior space 60. The interlining strip 54 is held in position within the interior space 60 of the hem 48 by two rows of stitches 68, 70. The first row of stitches 68 is near the inner edge 62, with the stitches 68 passing through the hem 48 (including a portion of the free end 66) and the interlining strip 54. The second row of stitches 70 is near the outer edge 64, with the stitches 70 passing through the hem 48 and the interlining strip 54. The interlining strip 54 extends generally the length of the hem 48.

As shown in FIG. 2, both the top and bottom hems 46, 48 are formed by folding over the sheet 36, so that their respective inner edges 72, 62 are at the upper surface 56 of the sheet 36. In contrast, the left and right hems 50, 52 are formed by folding under the sheet 36, so that their respective inner edges 74, 76 (shown in dashed lines) are at the lower surface 58 (FIG. 3) of the sheet 36.

As will be appreciated, the flat sheet 36 and interlining strips (as at 54) may be made of any suitable material(s). For example, the sheeting from which the sheet 36 is formed may be a woven or knit fabric made of one or more natural and/or synthetic materials. Likewise, one or more of the interlining strips (as at 54) may be formed from a woven or knit fabric made of one or more natural and/or synthetic materials. Where an interlining strip 54 is formed from a fabric, the fabric may be cut on a bias, if desired. Alternatively, one or more of the interlining strips may be made of foam. In addition, the interlining strips may be fusible or non-fusible, and may be of a single-ply or multi-ply construction. If desired, the interlining strips may be made (e.g., cut) from a woven polyester fabric. One example is a fabric woven from Dacron 250® polyester fibers available from DuPont of Wilmington, Del. If a woven polyester fabric is used, the fabric may have a "medium" hand. Also, if desired, a woven polyester fabric may have a weight of about two oz./yd.$^2$. Depending on the properties desired, a particular hem may include a single interlining, and that interlining may extend along the entire length of the hem, or along only a portion of the length. In addition, a given hem may have more than one interlining associated with it. For example, a hem may have a first elongated strip adjacent, or spaced from, a second elongated strip.

In addition, the hems 46, 48, 50, 52 and associated elongated interlining strips 54 may be formed using any suitable manufacturing technique(s). For example, an interlined hem (such as hem 48 by way of example) may be made as follows. An elongated interlining strip 54 may be placed on a length of sheeting, parallel to, and near, an end to be hemmed. A free end portion of the sheeting then may be folded over and onto a lengthwise portion of the interlining strip, and the free end portion/interlining combination may be doubled back onto the sheeting—thereby forming a hem 48 having an interior space 60, with the interlining strip 54 positioned in the interior space 60. Alternatively, a lengthwise edge of an interlining strip may be sewn to an end of the sheeting via a row of overcast stitching (not shown); and this combination then may be folded (i.e., doubled) back onto the sheeting, thereby forming a hem having an interior space, with the interlining positioned in the interior space. With either approach, a first row of stitches 68 may be sewn through the hem 48 and interlining strip 54, along the length of the hem 48 near the hem inner edge 62. And a second row of stitches 70 may be sewn through the hem 48 and interlining strip 54, along the length of the hem 48 near the hem outer edge 64. Also, each end of the hem 48 may be closed with a row of stitches (not shown).

Figure 4:
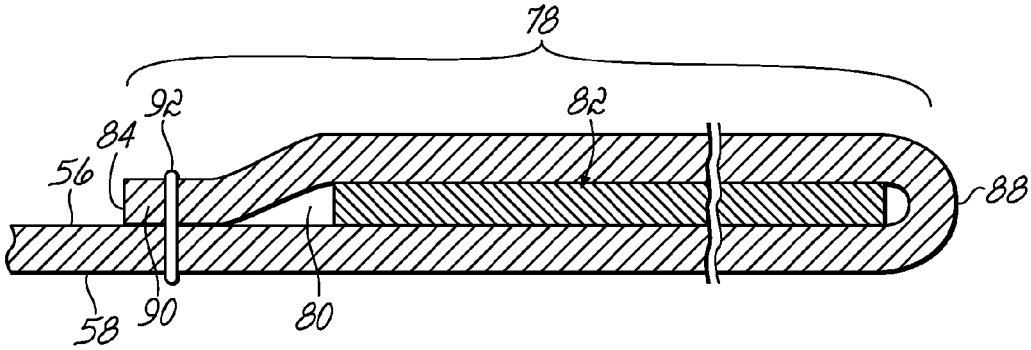
FIG. 4 is a cross-sectional view similar to FIG. 3, but showing another way to associate an interlining with a hem.

With reference to FIG. 4, an alternative bed sheet hem 78 (which may be used in place of one or more of the hems 46, 48, 50, 52), in accordance with the principles of the invention, defines an elongated interior space 80. An elongated interlining strip 82 is contained in the interior space 80, but is neither sewn nor fused to the hem 78; instead the interlining strip 82 is "free floating" within the space 80. The hem 78, itself, has an inner edge 84 at the upper surface 56 (or lower surface 58, if a left-side-end hem or a right-side-end hem) of the bed sheet, and an outer edge 88 spaced from the inner edge 84. In addition, the hem 78 has a free end 90 that is positioned in a generally flat orientation on the upper surface 56 (or lower surface 58, if a left-side-end hem or a right-side-end hem) of the sheet, with the outermost part of the free end 90 defining the hem inner edge 84. The hem 78 further includes a single row of stitches 92 near the inner edge 84, with the stitches 92 passing through the hem 78, but not through the "free floating" interlining strip 82.

Figure 5:
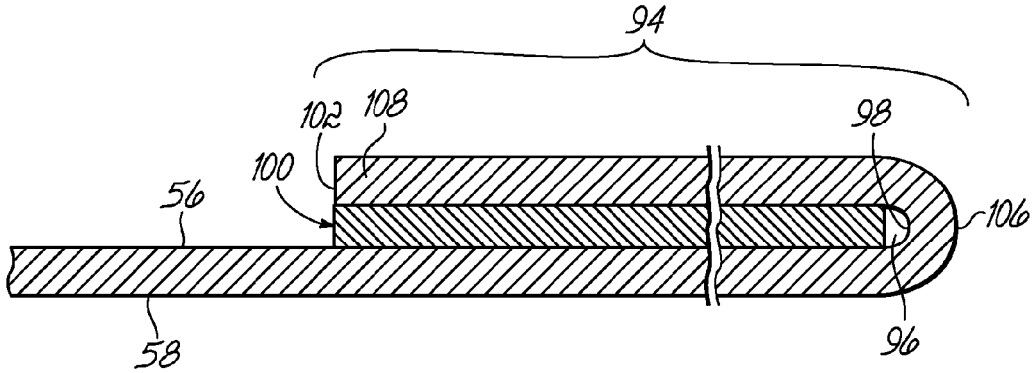
FIG. 5 is a cross-sectional view similar to FIG. 3, but showing a further way to associate an interlining with a hem.

With reference to FIG. 5, a further alternative bed sheet hem 94 (which may be used in place of one or more of the hems 46, 48, 50, 52), in accordance with the principles of the invention, is a stitch-free hem that defines an elongated interior space 96, with the hem 94 further including an interior surface 98. A fusible elongated interlining strip 100, is fused to the interior surface 98, and thereby is contained in the interior space 96. The hem 94, itself, has an inner edge 102 at the upper surface 56 (or lower surface 58, if a left-side-end hem or a right-side-end hem) of the bed sheet, and an outer edge 106 spaced from the inner edge 102. In addition, the hem 94 has a free end 108 that is positioned on, and fused to, a portion of the upper surface 56 (or lower surface 58, if a left-side-end hem or a right-side-end hem) of the interlining strip 100, with the outermost part of the free end 108 defining the hem inner edge 102.

In use, a bed sheet that includes a hem having an associated interlining may serve, for example, as a decorative top sheet or as a top sheet positioned beneath a blanket or the like.

The bed sheets described above provide several benefits and advantages. For example, the bed sheet hems have a greater resistance to creasing and wrinkling, without sacrificing the comfortable feel of the bedding.

By virtue of the foregoing, there is thus provided bedding, for example, sheets, pillow cases, pillow shams, dust ruffles, blankets, bedspreads, and duvet covers, in which the hems have a greater resistance to creasing and wrinkling than those of conventional bedding, without sacrificing the comfortable feel of the bedding.

While the present invention has been illustrated by a description of various embodiments, and while the illustrative embodiments have been described in considerable detail, it is not the intention of the inventor to restrict or in any way limit the scope of the appended claims to such detail. Furthermore, additional advantages and modifications will readily appear to those skilled in the art. For example, although the drawings illustrate various flat bed sheets, the invention encompasses additional bedding products, for example, other types of bed sheets, pillow cases, pillow shams, dust ruffles, blankets, bedspreads, and duvet covers. For a pillow case, the circumferential opening of the pillow case may be defined by a hem and an associated interlining. In constructing the pillow case, if desired, an interlined hem may be formed along an end of a length of sheeting, as described above in connection with the flat sheet 36. The sheeting then may be further cut, folded, and sewn to form the pillow case. Also, for the embodiments depicted and described above, terms such as top, bottom, left (side), right (side), upper, and lower have been used. As will be appreciated, however, these are simply terms of relative orientation. Accordingly, by way of example, an end that has been designated a top end may be a left-, right-, or bottom-end depending on the nature and orientation of the particular bedding product. Likewise, a surface that has been designated an upper surface may be a lower surface. The invention in its broader aspects is therefore not limited to the specific details, representative apparatus and methods, and illustrative examples shown and described. Accordingly, departures may be made from such details without departing from the spirit or scope of the inventor's general inventive concept.

What is claimed is:

1. A bed sheet, comprising:

a length of sheeting including a top end, a bottom end, a left side end, and a right side end, each end including a hem having an interlining associated therewith, wherein for at least one of the ends the hem defines an interior space with at least a portion of the associated interlining being contained in the interior space, wherein the hem includes an inner edge, an outer edge, and a width therebetween, and wherein the hem includes a first plurality of stitches being proximate the inner edge and a second plurality of stitches between the first plurality of stitches and the outer edge, at least some of the first plurality of stitches and at least some of the second plurality of stitches passing through the interlining.

2. The bed sheet of claim 1 wherein, for at least one of the ends, the associated interlining extends generally the length of the hem.

3. The bed sheet of claim 1 wherein, for at least one of the ends, the associated interlining includes a piece of fabric.

4. The bed sheet of claim 1 wherein, for at least one of the ends, the interlining is not fused to the hem.

5. The bed sheet of claim 1, wherein each of the hems defines an interior space with at least a portion of the associated interlining being contained in the interior space, wherein each of the hems includes an inner edge, an puter edge, and a width therebetween, and wherein each of the hems includes a first plurality of stitches being proximate the inner edge and a second plurality of stitches between the first plurality of stitches and the outer edge, at least some of the first plurality of stitches and at least some of the second plurality of stitches passing through the associated interlining.

6. The bed sheet of claim 5 wherein, for each of the ends, the associated interlining extends generally the length of the hem.

7. A bed sheet, comprising:

a length of sheeting including a top end, a bottom end, a left side end, and a right side end, at least one of the ends including a hem having an interlining associated therewith, wherein the hem defines an interior space with at least a portion of the associated interlining being contained in the interior space, wherein the hem includes an inner edge, an outer edge, and a width therebetween, and wherein the hem includes a first plurality of stitches being proximate the inner edge and extending generally the length of the hem and a second plurality of stitches between the first plurality of stitches and the outer edge, the second plurality of stitches extending generally the length of the hem, at least some of the first plurality of stitches and at least some of the second plurality of stitches passing through the interlining, wherein the associated interlining extends generally the length of the hem.

8. The bed sheet of claim 7 wherein the associated interlining includes a piece of fabric.

9. The bed sheet of claim 7 wherein the interlining is not fused to the hem.

10. The bed sheet of claim 7, the second plurality of stitching extending generally parallel to the first plurality of stitching.

11. A bed sheet, comprising:

a length of sheeting including a top end, a bottom end, a left side end, and a right side end, at least one of the ends including a hem interlining associated therewith, wherein the hem defines an interior space with at least a portion of the associated interlining being contained in the interior space, wherein the hem includes an inner edge, an outer edge, and a width therebetween, and wherein the hem includes a first plurality of stitches being proximate the inner edge and a second plurality of stitches between the first plurality of stitches and the outer edge, at least some of the first plurality of stitches and at least some of the second plurality of stitches passing through the interlining, wherein the associated interlining extends generally the length of the hem.

12. A bedding product, comprising:

a piece of fabric constructed and arranged so as to form the bedding product, the bedding product further comprising an end including a hem having an interlining associated therewith wherein the hem includes an inner edge, an outer edge, and a width therebetween, and wherein the hem includes a first plurality of stitches being proximate the inner edge and extending generally the length of the hem, and a second plurality of stitches between the first plurality of stitches and the outer edge and extending generally the length of the hem, at least some of the first plurality of stitches and at least some of the second plurality of stitches passing through the interlining, wherein the hem defines an interior space with at least a portion of the associated interlining being contained in the interior space and wherein the associated interlining extends generally the length of the hem.

13. The bedding product of claim 11 wherein the bedding product is selected from the group consisting of a bed sheet, a pillow case, a pillow sham, a dust ruffle, a blanket, a bedspread, and a duvet cover.

14. The bedding product of claim 12, the second plurality of stitching extending generally parallel to the first plurality of stitching.

* * * * *

UNITED STATES PATENT AND TRADEMARK OFFICE

CERTIFICATE OF CORRECTION

PATENT NO. : 7,325,262 B2
APPLICATION NO. : 10/906695
DATED : February 5, 2008
INVENTOR(S) : Timothy F. Keith It is certified that error appears in the above-identified patent and that said Letters Patent is hereby corrected as shown below:

On the Title Page Item -56- Page 2
"Other Publications", Column 2
Line 7, "Koni Kom" should be --Koni Kim--

Column 1
Line 31, "purchase-and maintenance-costs" should be --purchase- and maintenance- costs--

Claim 5
Column 5, line 30, "an puter edge," should be --an outer edge,--

Claim 11
Column 6, line 15, "a hem interlining" should be --a hem having an interlining--

Claim 13
Column 6, line 46, "claim 11" should be --claim 12--

Signed and Sealed this

Twenty-seventh Day of May, 2008

JON W. DUDAS
*Director of the United States Patent and Trademark Office*